US006189475B1

(12) United States Patent
Coakley

(10) Patent No.: US 6,189,475 B1
(45) Date of Patent: Feb. 20, 2001

(54) PROPELLED CABLE FAIRING

(75) Inventor: David B. Coakley, Hyattsville, MD (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/598,753

(22) Filed: Jun. 22, 2000

(51) Int. Cl.[7] ..... B63G 8/14
(52) U.S. Cl. ..... 114/245; 367/20
(58) Field of Search ..... 114/243–247; 367/20, 106

(56) References Cited

U.S. PATENT DOCUMENTS

| | | | | |
|---|---|---|---|---|
| 3,176,646 | * | 4/1965 | Natwick et al. | 114/245 |
| 3,233,571 | * | 2/1966 | Rather et al. | 114/245 |
| 3,343,516 | | 9/1967 | Nichols et al. . | |
| 3,379,161 | | 4/1968 | Nichols et al. . | |
| 3,605,674 | | 9/1971 | Weese . | |
| 3,987,745 | | 10/1976 | Chaverebiere de Sal et al. . | |
| 4,290,124 | | 9/1981 | Cole . | |
| 4,709,355 | | 11/1987 | Woods et al. . | |
| 4,829,929 | | 5/1989 | Kerfoot . | |
| 4,843,996 | | 7/1989 | Darche . | |
| 5,050,445 | | 9/1991 | Duffy . | |

FOREIGN PATENT DOCUMENTS

| | | | | |
|---|---|---|---|---|
| 358402 | * | 3/1990 | (EP) | 114/245 |

* cited by examiner

*Primary Examiner*—Jesus D. Sotelo
(74) *Attorney, Agent, or Firm*—John Forrest; Jacob Shuster

(57) ABSTRACT

A propelled cable fairing system for towing objects underwater having a plurality of cable fairings, which are individually propelled by motorized propulsion to avoid the thrust of propellers to overcome normally encountered drag heretofore utilized, which required use of longer and thicker cables resulting in a loss of control over the position of the towed object. In addition, the relative position of the propelled cable fairing system is maintained through a set of serially linked motor controllers that sense the relative position of each propelled cable fairing relative to it adjacent propelled cable fairing. Variation in position of the propelled cable fairing from a target, causes increase in speed of the motor or alters its angle of attack in order to keep the propelled cable fairings in predetermined alignment with the adjacent cable fairing. By use of a plurality of rudders, the propelled cable fairing system allows the operator to maintain the towed object at desired horizontal and vertical positions.

25 Claims, 3 Drawing Sheets

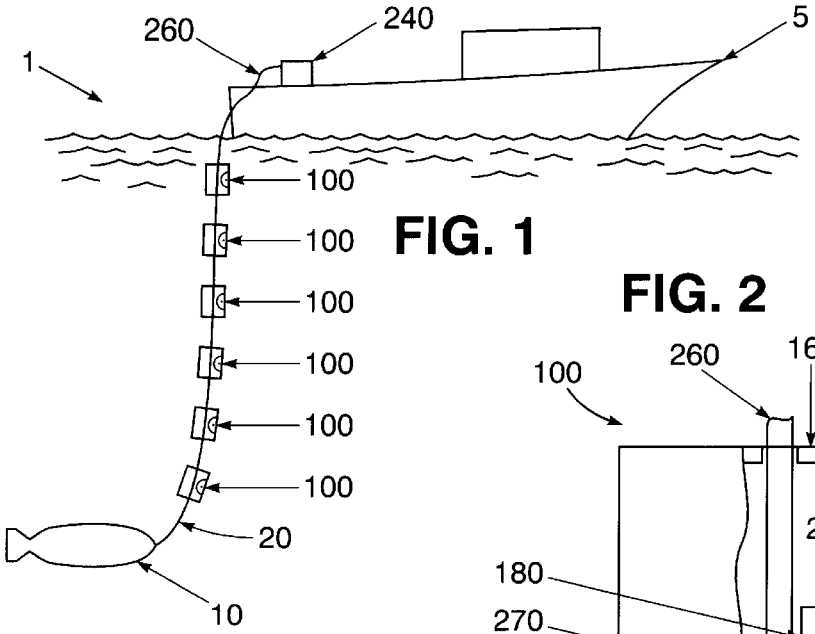
FIG. 1
FIG. 2
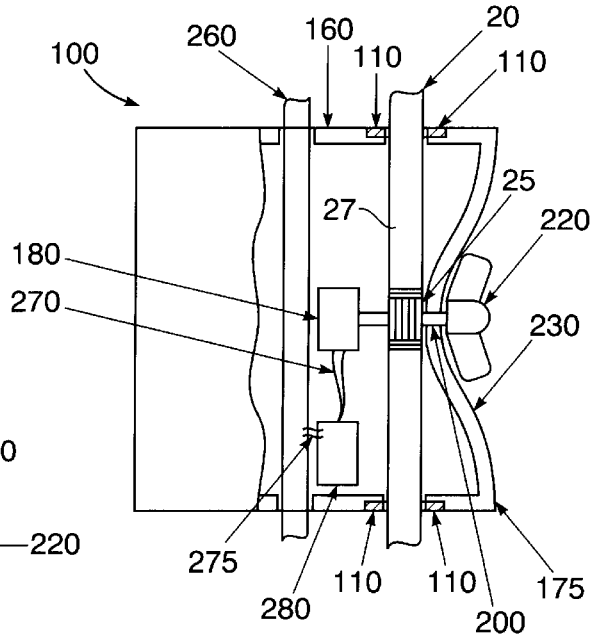
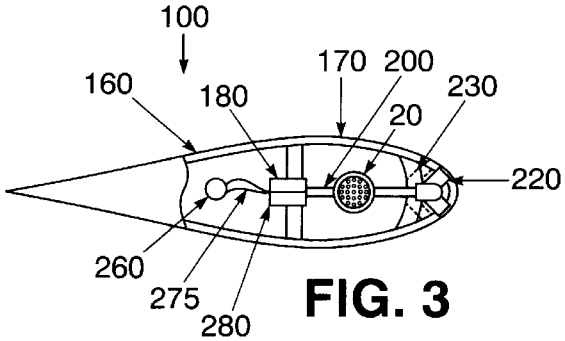
FIG. 3
FIG. 4
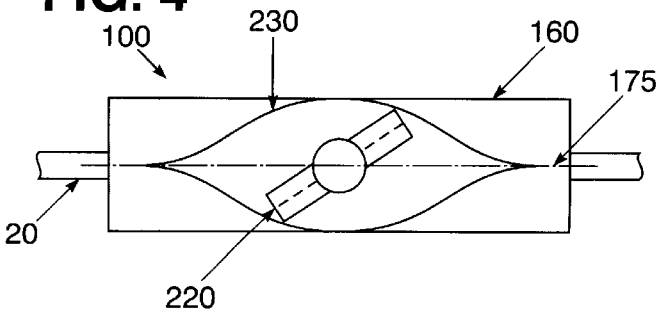
FIG. 5
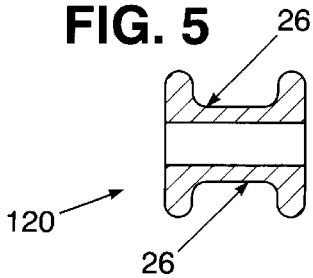

FIG. 10
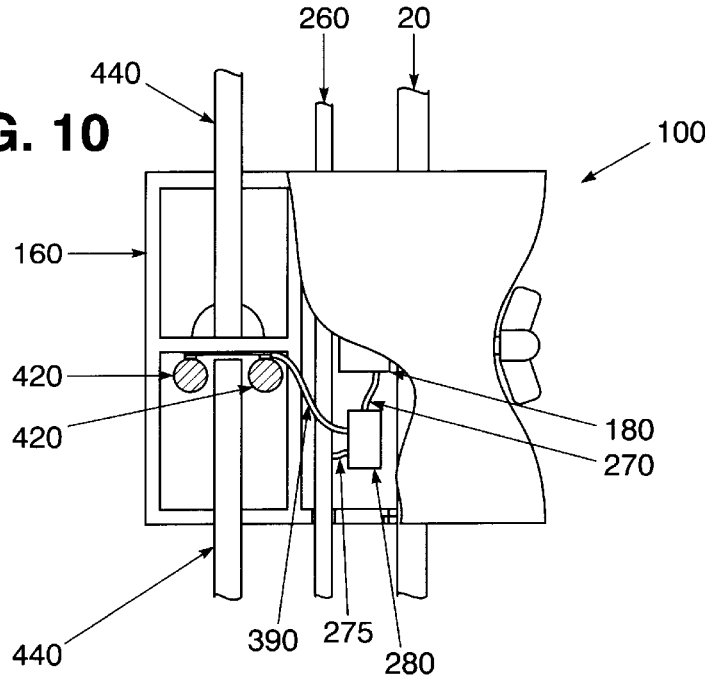
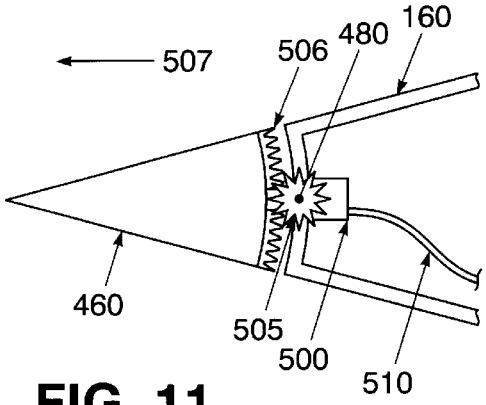
FIG. 11
FIG. 12
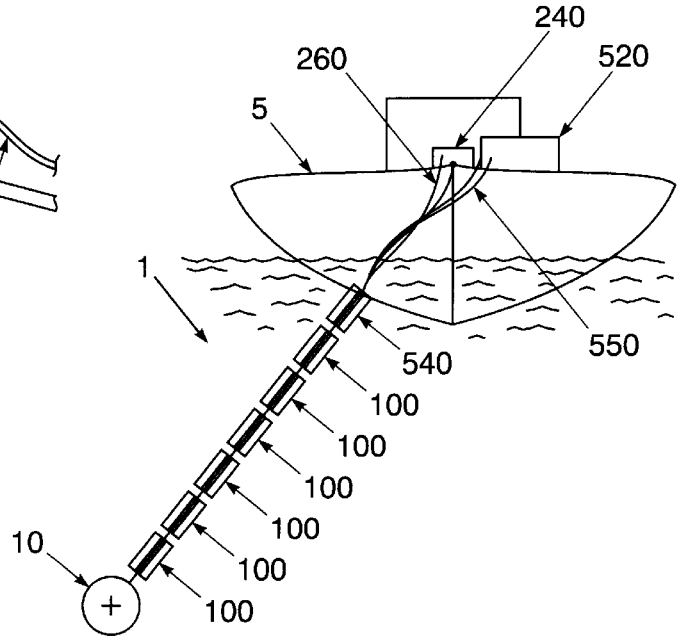

PROPELLED CABLE FAIRING

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates to the field of overcoming drag caused by the relative underwater flow of fluid past a cable. Specifically, this invention relates to the field of using improved tow cables to better control a submerged object.

2. Description of the Related Art

This invention relates to the towing of submerged objects, commonly called "fish." These fish can be sonar devices, deep-sea exploration vehicles, or other underwater vehicles that are towed underwater. These fish are often towed behind a towing vehicle, such as a ship or submarine. In addition, they can be tethered to a stationary object. The typical arrangement is for the towing vehicle to be a ship, which will be attached to the fish by a cable. In order to submerge the fish, the cable will be played out until the fish sinks to the desired depth.

The foregoing described arrangement is generally satisfactory either where a ship is moving relatively slowly, or where the current is minimal, or where the cable length is relatively short. However, depending on both the relative speed of the water flowing past the cable and the length of the cable, this arrangement can result in significant drag produced by the water on the cable. Because of such increased drag, more cable is required to maintain the fish at a given depth. As the length of the cable is increased, the weight of the entire towing apparatus increases. Furthermore, as the length of the cable increases, the operator's ability to control the fish decreases. Thus there has been a long felt need to find a way to reduce the effect of this drag in order to both reduce the amount of cable used, and to increase the operator's control over the fish at a desired depth.

To date, the prior art has focused on attempts to passively reduce drag on the cable, which generally consisted of improved fairing shapes. These fairings are airfoil-shaped coverings that are designed to streamline the profile of the cable in order to reduce drag on the cable. There are many types of such fairings. Examples are disclosed in U.S. Pat. No. 5,050,445, which describes a fairing that completely covers the cable, and in U.S. Pat. No. 4,829,929, which describe a fairing that only partially covers the cable. In a variation on the fairing system, systems utilizing ribbons to additionally reduce drag are shown in U.S. Pat. No. 4,843,996. Lastly, where a fish requires the use of electricity, other cables were designed that enclose both the cable and the electrical lines. Examples of the latter referred to systems are disclosed in U.S. Pat. Nos. 3,379,161 and 3,343,516. While these systems typically did reduce drag, they were unable to eliminate it totally since such systems all lacked the capacity to produce thrust. Since the production of thrust is the only way to truly overcome drag, such attempts to passively reduce drag prove only to be partially effective.

As previously noted, where cable lengths are lengthened, the capability to control the fish became more difficult. Since certain towing applications required greater control over the fish, attempts were made to devise systems that provided such control. The systems shown in U.S. Pat. Nos. 3,987,745 and 4,843,996 dealt with this problem by creating two fish: one that maintained a general base position, and a second that could explore out from the base position under its own power. However, such solution is not practicable in all towing situations.

Another technique has been largely confined to the field of towed hydrophone arrays where the cable needs to extend horizontally over great distances. In those situations, systems such as those disclosed in U.S. Pat. Nos. 3,605,674 and 4,290,124 use controllable wings attached to the cables. These wings maintain the cable horizontally at a predetermined depth as the entire array is towed. In other towing arrangements, such as that shown in U.S. Pat. No. 4,709,355, a closed loop feedback system is utilized where the controller is located on a ship and automatically maintains the wings at a desired angle to maintain or alter its depth based on sensor readings. However, such technology was never applied to the cable fairings used in towing fish, since without some means of providing thrust to the cable there was no way to correct a fairing segment to keep it in desired alignment.

Thus, prior to the present invention, there was no active means to overcome the drag on cable fairings, and no effective way to control the cable, resulting in the use of longer and thicker cables than those utilized in the system of the present invention.

SUMMARY OF THE INVENTION

Accordingly, pursuant to the present invention an active means is provided to overcome drag on cables used in the towing of submerged objects. Also according to the present invention, sufficient thrust is provided along the length of a cable used in the towing of submerged objects to allow a reduction in both the thickness and amount of cable used. Furthermore, a means is provided to increase the control over the towed object by decreasing the amount of cable that needs to be used in the towing of underwater objects. Still further, a propelled cable fairing is created that has the internal capability to maintain a relative position between adjacent fairings. Such propelled cable fairing also has the capability to maintain the cable at an angular position as it is towing a submerged object.

BRIEF DESCRIPTION OF THE DRAWING FIGURES

A more complete appreciation of the invention and many of its attendant advantages will be readily appreciated as the same becomes better understood by reference to the following detailed description when considered in connection with the accompanying drawing herein:

FIG. 1 is a side view of propelled cable fairing system showing the relative position of towing body, towed body, cable, and propelled cable fairings arrayed along the cable according to the present invention.

FIG. 2 a top view of the interior of an individual propelled cable fairing according to the present invention.

FIG. 3 is a side view of the interior of an individual propelled cable according to the present invention.

FIG. 4 is a front view of an individual propelled cable according to the present invention showing the placement of the propeller and the propeller duct.

FIG. 5 is a section view of a swage having grooves for use according to the present invention.

FIG. 10 is a top view of the interior of an individual propelled cable fairing showing the metal bar embodiment of the propelled cable fairing feedback control system according to the present invention.

FIG. 11 is a side view of the propelled cable fairing according to the present invention showing the alternative embodiment employing a rudder.

FIG. 12 is a view from the rear of the propelled cable fairing system showing the controller and the capacity of the system to maintain the cable at an angular position where the system further includes a rudder according to the present invention.

DESCRIPTION OF THE PREFERRED EMBODIMENT

Figure 6:
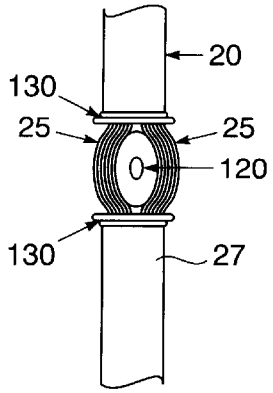
FIG. 6 is a front view of the swage shown with the cable according to the present invention.

As shown in FIG. 1, the propelled cable fairing system 1 includes the towing body 5, a towed body 10, a cable 20 connecting the towing body 5 to the towed body 10, and a set of propelled cable fairings 100 attached to the cable 20. Located on the towing body 5 is a power source 240, which provides power to the propelled cable fairings 100 by means of a power cable 260. The cable 20 is conventional in nature, but is untwisted in the preferred embodiment.

In the preferred embodiment, the towing body 5 is a ship, and the towed body 10 is a fish. However, the towing body 5 and the towed body 10 can be any two objects between which the cable 20 is strung so long as the cable 20 is exposed to a water flow, such as a current. In addition, the power source 240 shown provides electrical power. However, it is recognized that a power source 240 could also provide hydraulic or pneumatic forms of power to the propelled cable fairings 100 along with or instead of electric power, depending on the design chosen.

FIGS. 2, 3, and 4 provide a side, top, and front view of an individual propelled cable fairing 100. As shown in FIG. 2, the external structure of the propelled cable fairing 100 comprises a housing 160. As shown in FIG. 3, the housing 160 is in the shape of an airfoil having a maximum thickness 170 of between 10%–30%. In addition, the cable 20 extends through the width of the propelled cable fairing 100 near the point of maximum thickness 170. As shown in FIG. 2, the housing 160 is attached to the cable 20 through bearings 110.

In the preferred embodiment, the propulsion for the propelled cable fairing 100 is provided by a propeller 220. The propeller 220 is attached to a propeller shaft 200 such that the propeller 220 is flush with and behind the leading edge 175 of the housing 160. In order to flush mount the propeller 220, the housing 160 includes a propeller duct 230. The propeller duct 230 allows the wash produced by the propeller 220 to flow over the housing 160 in an aerodynamic fashion. However, it is recognized, but not shown, that the propeller 220 may also be mounted in front of the leading edge 175 of the housing 160. Whether mounted flush or in front of the leading edge 175, as shown in FIG. 4, the propeller is mounted in the center of the leading edge 175. It is recognized that other forms of propulsion may be used instead of the propeller 220, such as those using jets of water, gas or other similar means to produce thrust.

As shown in FIG. 2, in the preferred embodiment, the motor 180 is located behind the cable 20. As such, the propeller shaft 200, which transmits the power from the motor 180 to the propeller 220, extends through the cable 20. In order to extend through the cable 20, the preferred embodiment employs a swage 120, as shown in FIGS. 5 and 6. The swage 120 has grooves 26 and as shown in FIG. 6 is in the cable 20, separating the strands 25 thereof to allow the propeller shaft 200 to pass through the cable 20. The grooves 26 allow the strands 25 to pass around the swage 120 in spaced relation to the propeller shaft 200 to prevent interference therewith. In order to attach the swage 120, the strands 25 are exposed by removing a portion of covering 27 from the cable 20. Above and below the swage 120, the cable 20 is bound by bands 130. Thus, as shown in FIG. 2, using the swage 120 to define a passageway through the cable 20, the propeller shaft 200 is able to extend from the motor 180 to the propeller 220. The swage 120 is preferably of a hard material, such as metal or a hard plastic.

It is recognized that there are other means to transmit power from the motor 180 to the propeller 220 which might not require the use of the swage 120. Other possible mechanisms include flexible shafts, placing the motor 180 in front of the cable 20, or even directly connecting the motor to the propeller as is done in radial engines. If the propeller is banded, the band may be driven electromagnetically.

In the preferred embodiment shown in FIG. 2, the motor 180 is an electric motor. The motor 180 is attached through controller cables 270 to a motor controller 280. The motor controller 280 provides input to the motor 180, which determines the speed at which the propeller 220 turns, thus controlling the thrust of the individual propelled cable fairing 100. The motor controller 280 is electrically attached to the power cable 260 through power cables 275.

In its simplest embodiment, the motor controller 280 would keep the thrust constant or respond to signals from the towing body 5 or the towed body 10. However, where there is a need for each propelled cable fairing 100 to control its alignment with its adjacent propelled cable fairing, each propelled cable fairing 100 would have a closed loop feedback system which would provide an automatic relative position control between these propelled cable fairings. This propelled cable fairing feedback control system would control the motor controller 280 and vary the thrust according to the relative position of the propelled cable fairing 100 to its adjacent propelled cable fairing.

Figure 7:
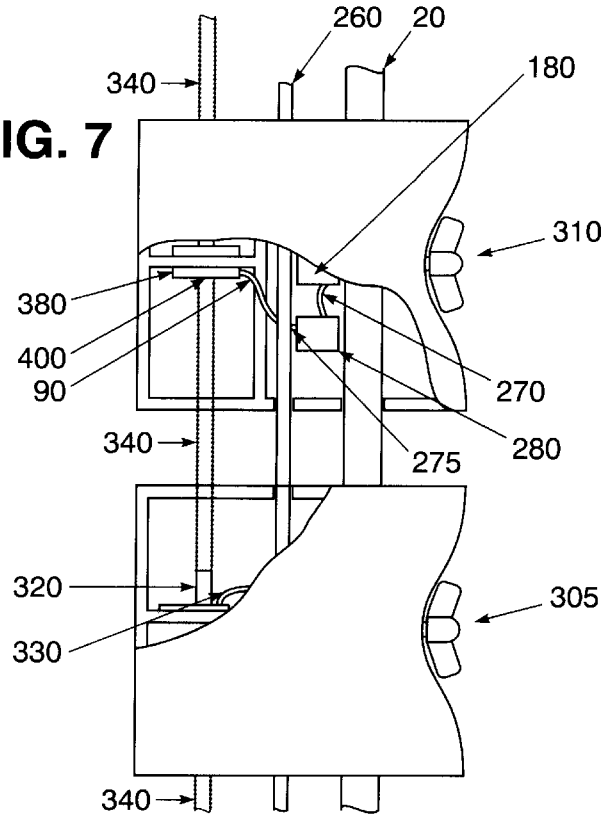
FIG. 7 is a top view of the laser diode control system showing the laser beams linking the receiving propelled cable fairing to its adjacent propelled cable fairing according to the present invention.

A preferred embodiment of the propelled cable fairing feedback control system is shown in FIG. 7. According to this preferred embodiment, the propelled cable fairing feedback control system comprises a series of linked propelled cable fairings 100. Each link is a laser beam 340 that extends between adjacent propelled cable fairings. Specifically, the laser beam 340 extends from a first propelled cable fairing 305 to a second propelled cable fairing 310. The laser beam 340 is produced by the fixed laser diode 320 in the first propelled cable fairing 305. The laser diode 320 is aimed at a target 400 on a position sensitive device 380 located on the second propelled cable fairing 310. This target 400 is normally the center of the position sensitive device 380. Since the output of position sensitive device 380 is dependent on the position of the laser beam 340 relative to the target 400, the motor controller 280 is able to sense the relative position of the first propelled cable fairing 305. Where the laser beam 340 is not on the target 400, the motor controller 280 will accordingly adjust the speed of the motor 180 to move the second propelled cable fairing 310 such that the laser beam 340 is brought onto the target 400.

Figure 8:
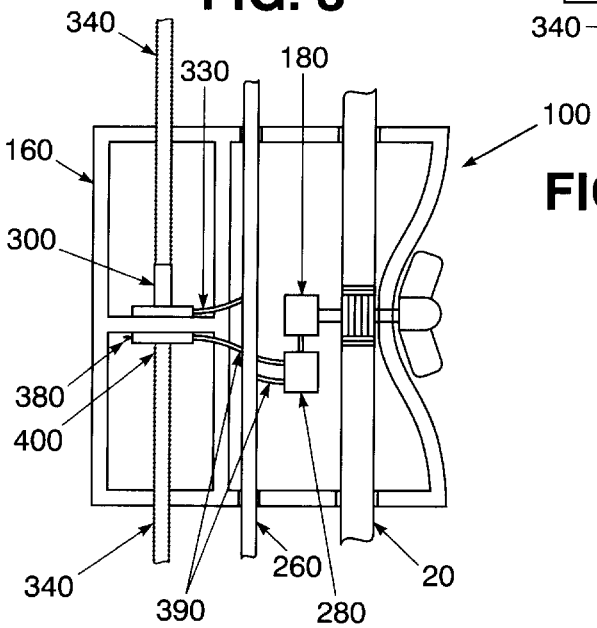
FIG. 8 is a top view of the interior of an individual propelled cable fairing showing the laser diode control system embodiment of the propelled cable fairing feedback control system according to the present invention.

As shown in FIG. 8, this embodiment of the propelled cable fairing feedback control system requires that each propelled cable fairing 100 includes a laser diode 300, which receives power from the power source 240 by being electrically connected to the power cable 260 via power cables 330. This laser diode 300 generates a laser beam 340 that will communicate its position to an adjacent propelled cable fairing 100 (not shown). In addition, each propelled cable fairing 100 includes a position sensitive device 380, which is electrically connected to the motor controller 280 via sensor cables 390. Such position sensitive device 380 receives a laser beam 340 from an adjacent propelled cable fairing 100 (not shown), and produces an output indicating the position of the laser beam 340. Through these sensor cables 390, the motor controller 280 is able to sense the output of the position sensitive device 380, evaluate this output as compared to the output received when the laser beam 340 is received at the target 400 (not shown), and adjust the speed of the motor 180 according to this output. Such control may be proportional, proportionally derivative or proportional derivative integral. As shown in FIG. 7, by linking the propelled cable fairings 100 in this way, each propelled cable fairing 100 can communicate its relative position to one adjacent propelled cable fairing 100, while simultaneously being able to automatically maintain its relative position relative to another adjacent propelled cable fairing 100.

Figure 9:
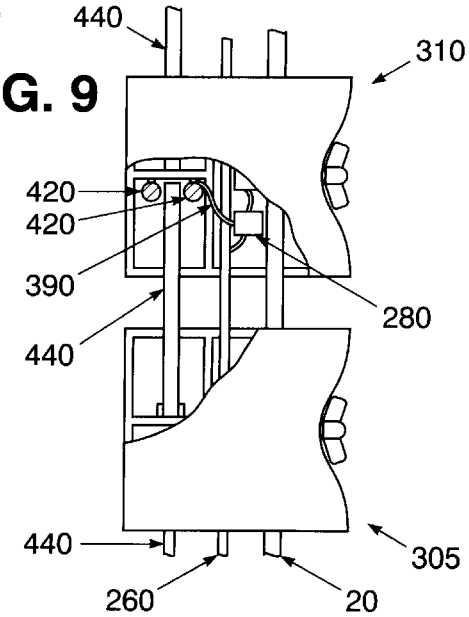
FIG. 9 is a top view of the metallic rod embodiment according to the present invention showing the metallic rods linking the receiving propelled cable fairing to its adjacent propelled cable fairing according to the present invention.

In FIG. 9, an alternative linking mechanism is shown to keep the propelled cable fairing system 1 in alignment. In this embodiment, the propelled cable fairing feedback control system utilizes metallic rods 440, which extend from a first propelled cable fairing 305 into a second propelled cable fairing 310 where the metallic rod 440 is received by the metal sensing magnets 420. Each metallic rod 440 contains sufficient metallic content to allow it to be sensed by these metal sensing magnets 420, and is stiffer than the cable 20. These metal sensing magnets 420 have a target area 430 (not shown), which represents an ideal position for the metallic rod 420. Through the sensor cables 390, the motor controller 280 in the second propelled cable fairing 310 senses the position of the metallic rod 440, evaluates this position relative to the target area 430 of the metal sensing magnets 420, and adjusts the speed of its motor 180 to move the metallic bar 440 onto the target are 430. In this way, the position of the first propelled cable fairing 305 is communicated to the second propelled cable fairing 310, so that the motor controller and the second propelled cable fairing 310 can align with the first propelled cable fairing 305.

As shown in FIG. 10, the motor controller 280 is electrically attached to the metal sensing magnets 420 through sensor cables 390. Both the metal sensing magnets 420 and the metallic rod 440 are attached to the housing 160. It is the metallic rod 440 which will communicate the position of the propelled cable fairing 100 to an adjacent propelled cable fairing 100 (not shown). By linking the propelled cable fairings 100 in this way, each propelled cable fairing 100 can communicate its relative position to one adjacent propelled cable fairing 100, while at the same time automatically maintaining its relative position relative to another adjacent propelled cable fairing 100.

In another embodiment shown in FIG. 11, the propelled cable fairing 100 can be adjusted to maintain a desired angle of attack/attitude relative to the free flow of the water 507. The embodiment shown uses a rudder 460 that is attached to the housing 160 of the propelled cable fairing 100 by a hinge 480. The rotation of the rudder 460 about the hinge 480 is controlled by an actuator 500, which is also attached to the housing 160. The actuator 500 is connected to the rudder 460 by a gear 505. Gear 505 engages the rudder teeth 506 to allow the actuator to control the movement of rudder 460. Since other conventional connections between actuators and rudders are available, such as the electrical or hydraulic systems, they may also be utilized between servos and rudders on aircraft.

In the preferred embodiment, the actuator 500 is electrically connected to the motor controller 280 through power cables 510. The actuator 500 is controlled by the motor controller 280 to control both the speed of the motor 180 and the actuator 500 so as to automatically maintain and adjust both the relative speed and the attitude of the propelled cable fairing 100. It is understood, that the actuator 500 might be controlled by a separate control system existing outside of the motor controller 280 so long as this separate control system relies upon the input from the propelled cable fairing feedback control system that indicates the relative position of adjacent propelled cable fairing 100. Although not shown, it is also understood that the rudder 460 might be replaced by a plurality of rudders, and that these rudders may be positioned along the fairing close to its maximum thickness so long as the rudders can provide the attitudinal control desired for a given application.

Where an embodiment includes a rudder 460, there is an additional advantage: the entire propelled cable fairing system 1 can be made to pivot about the towing body 5 as shown in FIG. 12. In such preferred embodiment as shown, this pivot is accomplished by controlling the attitude of the primary propelled cable fairing 540, whose position determines the relative position of the other propelled cable fairings 100. In the laser diode embodiment for the propelled cable fairing feedback control system, the primary propelled cable fairing 540 is the propelled cable fairing 100 that has a laser beam 340 extending from it into an adjacent propelled cable fairing, but does not receive a laser beam 340 from an adjacent propelled cable fairing. Where the metallic rod embodiment of the propelled cable fairing feedback control system is employed, the primary propelled cable fairing 540 is the propelled cable fairing 100 that extends its metallic rod 440 into an adjacent propelled cable fairing, but which receives no metallic rod 440 from an adjacent propelled cable fairing. Whichever propelled cable fairing feedback system is employed, by controlling this primary propelled cable fairing 540, all other propelled cable fairings 100 can be rotated, manipulated, or otherwise controlled by merely controlling the primary propelled cable fairing 540.

In order to control the primary propelled cable fairing 540, the embodiment shown in FIG. 12 uses the controller 520 to both communicate a position command to the primary propelled cable fairing 540 through system control cables 550, and to maintain this position command. These system control cables 550 are connected to the motor controller 280 of the primary propelled cable fairing 540. It is understood that communication need not be through a hardwired system such as heretofore described, but may be through other conventional means such as radio waves, or, depending on the propelled cable fairing feedback control system used, linking the controller 520 to the primary propelled cable fairing 540 using either metallic rods and laser beams as appropriate.

However communicated, communication provides the motor controller 280 for the primary propelled cable fairing 540 with a desired attitude for the propelled cable fairing system 1. The motor controller 280 adjusts the motor 180 and rudder 460 of the primary propelled cable fairing 540 to reach the desired attitude. Since the relative position of the propelled cable fairings 100 are dependent on the position of the primary propelled cable fairing 540, the use of the controller 520 allows the operator to manipulate the attitude of the entire propelled cable fairing system 1 as shown in FIG. 12.

Obviously, other modifications and variations of the present invention may be possible in light of the foregoing teachings. It is therefore to be understood that within the scope of the appended claims the invention may be practiced otherwise than as specifically described.

What is claimed is:

1. A propelled cable fairing system comprising:

a cable; and a plurality of propelled cable fairings attached to said cable;

each of said propelled cable fairings including: a housing, and means for providing propulsion to the propelled cable fairing.

2. The propelled cable fairing system of claim 1 wherein said housing is a fairing.

3. The propelled cable fairing system of claim 2 wherein said fairing has a cross-sectional shape of an airfoil.

4. The propelled cable fairing system of claim 3 wherein said cable passes through the fairing of the said propelled cable.

5. The propelled cable fairing system of claim 4 wherein said means for providing propulsion comprises: a motor, a propeller, and a means for transmitting power from said motor to said propeller.

6. The propelled cable fairing system of claim 5 wherein said motor is attached inside said fairing.

7. The propelled cable fairing system of claim 6 wherein said motor is located behind said cable relative to said propeller, and said means for transmitting power from said motor comprises a propeller shaft.

8. A propelled cable fairing system comprising:

a cable;

a plurality of propelled cable fairings attached to said cable;

each of said propelled cable fairings including: a housing, means for providing propulsion to said propelled cable fairing; and a propelled cable fairing feedback control system for controlling said propulsion providing means so as to maintain said propelled cable fairings in alignment relative to each other.

9. The propelled cable fairing system of claim 8 wherein said propelled cable fairing feedback control system comprises: means for communicating relative positions between adjacent propelled cable fairings including: a first propelled cable fairing and a second propelled cable fairing; said first propelled cable fairing containing means for indicating position of the first and second propelled cable fairings relative to said second propelled cable fairing, said second propelled cable fairing including: means for evaluating said means for indicating the relative position of said first and second propelled cable fairings; and means for adjusting said means for providing propulsion in response to said means for evaluating so as to maintain said first and second propelled cable fairings in alignment relative to each other.

10. The propelled cable fairing system of claim 9 wherein said housing is a fairing having a cross-sectional shape of an airfoil.

11. The propelled cable fairing system of claim 9 wherein said means for communicating relative positions between adjacent propelled cable fairings comprises means for providing a plurality of beams; said means for indicating the relative position of the first and second propelled cable fairings to said second propelled cable fairing involving at least one of said beams transmitted between said first and second propelled cable fairings; said first propelled cable fairing further including means for generating said beam in said first propelled cable fairing; and wherein said means for evaluating comprises means for receiving said beam in said second propelled cable fairing and means for comparing said beam received with position of an ideal received beam.

12. The propelled cable fairing system of claim 11 wherein said beam is laser radiation.

13. The propelled cable fairing system of claim 12 wherein said means for generating said laser beam includes a laser diode, and said means for receiving said laser beam comprises a position sensitive device having a target representing position of an ideal received laser beam; said means for comparing said received laser beam including a motor controller sensing the position of said laser beam on said position sensitive device relative to said target; and wherein said adjusting means for providing propulsion includes said motor controller adjusting said means for providing propulsion to increase or decrease the speed of second propelled cable fairing to maintain said laser beam approximately focused on said target.

14. The propelled cable fairing system of claim 13 wherein said means for providing propulsion comprises a motor, a propeller attached to said fairing, and a means for transmitting power from said motor to said propeller.

15. The propelled cable fairing system of claim 14 wherein said motor is attached inside said fairing.

16. The propelled cable fairing system of claim 15 wherein said motor is located behind said cable relative to said propeller, and said means for transmitting power from said motor comprises a propeller shaft.

17. The propelled cable fairing system of claim 13 wherein said propelled cable fairings further include at least one rudder hingedly attached to said fairing, at least one actuator inside said fairing wherein said actuator controls said rudder, and wherein said propelled cable fairing feedback control system further includes a means for maintaining said propelled cable fairings at a desired angle of attack.

18. The propelled cable fairing system of claim 17 further including a primary propelled cable fairing and a primary controller in communication with said primary propelled cable fairing to control said motor controller in said primary propelled cable fairing; said primary controller including means for maintaining said primary propelled cable fairing at an angle of attack to adjust in angle of attack the propelled cable fairings to match the angle of attack of said primary propelled cable fairings and thereby pivot the propelled cable fairing system.

19. The propelled cable fairing system of claim 9 wherein said means for communicating relative positions between adjacent propelled cable fairings comprises a plurality of rods; and said means for indicating the position of the first and second propelled cable fairings relative to said second propelled cable fairing including at least one of said rods attached to said first propelled cable fairing and extending to said second propelled cable fairing; and wherein said means for evaluating comprises means for sensing position of said one rod in said second propelled cable fairing and means for comparing the sensed position of said one rod with an ideal position thereof.

20. The propelled cable fairing system of claim 19 wherein said rod is metallic, said means for sensing the position of said rod including a plurality of metal sensing magnets, and said means for comparing said sensed position of the rod includes a motor controller sensing position of said rod through said metal sensing magnets relative to said ideal position; and wherein said means for adjusting said means for providing propulsion involves said motor controller adjusting said means for providing propulsion to increase or decrease speed of the second propelled cable fairing to maintain said rod at approximately said ideal position.

21. The propelled cable fairing system of claim 20 wherein said means for providing propulsion comprises a motor, a propeller attached to said fairing, and a means for transmitting power from said motor to said propeller.

22. The propelled cable fairing system of claim 21 wherein said motor is attached inside said fairing.

23. The propelled cable fairing system of claim 22 wherein said motor is located behind said cable relative to said propeller, and said means for transmitting power from said motor comprises a propeller shaft.

24. The propelled cable fairing system of claim 20 wherein said propelled cable fairings further include at least one rudder hingedly attached to said fairing and at least one actuator inside said fairing; wherein said actuator controls said rudder; and wherein said propelled cable fairing feedback control system further includes means for maintaining said propelled cable fairings at a desired angle of attack.

25. The propelled cable fairing system of claim 24 further including a primary propelled cable fairing and a primary controller in communication with said primary propelled cable fairing; wherein said primary controller controls said motor controller in said primary propelled cable fairing; and wherein said primary controller includes means for maintaining said primary propelled cable fairing at an angle of attack adjusted of match the propelled cable fairings and thereby pivot the propelled cable fairing system.

* * * * *